US007425155B2

(12) United States Patent
Takeuchi

(10) Patent No.: US 7,425,155 B2
(45) Date of Patent: Sep. 16, 2008

(54) ELECTRICAL CONNECTOR

(75) Inventor: Yousuke Takeuchi, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/896,190

(22) Filed: Aug. 30, 2007

(65) Prior Publication Data

US 2008/0090457 A1 Apr. 17, 2008

(30) Foreign Application Priority Data

Oct. 17, 2006 (JP) ..... 2006-282847

(51) Int. Cl.
*H01R 13/648* (2006.01)

(52) U.S. Cl. ..... 439/607

(58) Field of Classification Search ..... 439/607, 439/608, 610

See application file for complete search history.

(56) References Cited

U.S. PATENT DOCUMENTS 5,683,269 A * 11/1997 Davis et al. ..... 439/607
5,944,559 A * 8/1999 Wu ..... 439/607
6,039,606 A * 3/2000 Chiou ..... 439/610

FOREIGN PATENT DOCUMENTS

JP 2002298985 10/2002

OTHER PUBLICATIONS

European Search Report, Feb. 12, 2008.

* cited by examiner

*Primary Examiner*—Phuong K Dinh
(74) *Attorney, Agent, or Firm*—Kubotera & Associates, LLC

(57) ABSTRACT

An electric connector to be connected to a mating connector includes a plurality of terminals each having a fixed portion; a housing for holding the terminals; and a shielding member attached to the housing. The housing includes a housing body portion for holding the fixed portions and a housing fitting portion for arranging the terminals. The shielding member includes a first shielding member and a second shielding member. The first shielding member includes a shield fitting portion for covering the housing fitting portion; a first shield body portion for covering the housing body portion; and a connection portion. The shield fitting portion has a hole portion. The second shielding member includes a second shield body portion for covering the housing body portion and an extending portion extending from the second shield body portion toward the shield fitting portion. The extending portion has a protruding portion inserted into the hole portion.

7 Claims, 13 Drawing Sheets

ELECTRICAL CONNECTOR

FIELD OF THE INVENTION AND RELATED ART STATEMENT

The present invention is related to an electrical connector. More specifically, the present invention is related to a plug connector provided in an end portion of a cable.

In a cellular phone, a PDA, and other portable electronic device and the like, an electrical connector (plug connector) provided in an end portion of a cable may be fitted into a connector (receptacle connector) of an electronic device for transmitting a signal or recharging. In such connectors, an excessive force, i.e., a twisting force or the like, may be imposed when a plug connector and a receptacle connector are fitted. Accordingly, it is necessary to increase strength against the twisting force.

In Japanese Patent Publication No. 2002-298985 (Patent Reference), a plug connector shown in FIG. 13 is disclosed. The plug connector comprises a grasp portion 100 attached to a cable terminal and formed of a resin, and a fitting portion 112 protruding from the grasp portion 100 to fit into a mating connector.

More specifically, the connector is provided with a housing (not shown) holding a plurality of contacts in parallel and a shielding member to cover the outer circumference of the housing. The shielding member includes a first member 120 having a fitting portion with a tubular shape and a second member 140 fixed to the first member 120. When through holes 125*a* to 125*c* provided in the second member 140 engage pin portions 146*a* and 146*b* and a convex portion 147 provided in the first member 120, the first member 120 is positioned relative to the second member 140. Further, it is possible to provide strength against a bending force (twisting force).

Patent Reference Japanese Patent Publication No. 2002-298985

In the connector disclosed in Patent Reference, it is difficult to provide sufficient strength against the twisting force. Further, it is necessary to accurately form the pin portions 146*a* and 146*b* and the convex portion 147 in a separate bending process, so that the pin portions 146*a* and 146*b* and the convex portion 147 are accurately inserted into the through holes 125*a* to 125*c*; thereby making the production process complicated. Further, when the pin portions 146*a* and 146*b* and the convex portion 147 are formed, the connector has a large height, thereby making it difficult to reduce a size of the connector to meet a recent trend.

In the view of the problems described above, an object of the present invention is to provide a connector with improved strength against the twisting force through a simple production process.

Further objects and advantages of the invention will be apparent from the following description of the invention.

SUMMARY OF THE INVENTION

In order to attain the objects described above, according to the present invention, an electric connector includes a housing for holding a plurality of terminals; and a shielding member attached to an outer circumference of the housing. The housing has a housing body portion for holding fixed portions of the terminals and a housing fitting portion with the terminals arranged thereon along a protruding direction. The housing fitting portion protrudes from the housing body portion toward a mating connector and has a plate shape. The shielding member includes a first shielding member and a second shielding member. The first shielding member includes a shield fitting portion having a tubular shape for covering the housing fitting portion; a first shield body portion for covering a part of the housing body portion; and a connection portion for connecting the shield fitting portion to the first shield body portion. The second shielding member includes a second shield body portion for covering a part of the housing body portion and an extending portion extending from the second shield body portion toward the shield fitting portion. The shield fitting portion of the first shielding member is provided with at least one dent portion in a base portion thereof. The extending portion is provided with a protruding portion inserted into the dent portion.

In the electric connector described above, the shield fitting portion may have a regulating portion for regulating the extending portion.

In the electric connector described above, the regulating portion may be situated on an opposite side with respect to the dent portion in the protruding direction. Further, the regulating portion may be a protruding portion protruding toward the second shielding member.

Further, in the electric connector described above, the shield fitting portion may have a held portion protruding in a direction opposite to the protruding direction and inserted into a groove provided in the housing body portion.

In the present invention, it is possible to provide the electrical connector with a small size and improved strength against a twisting force through a simple production process.

DETAILED DESCRIPTION OF THE PREFERRED EMBODIMENTS

Hereunder, embodiments of the present invention will be explained with reference to the accompanying drawings. An electrical connector is explained as an example of the present invention.

Figure 1:
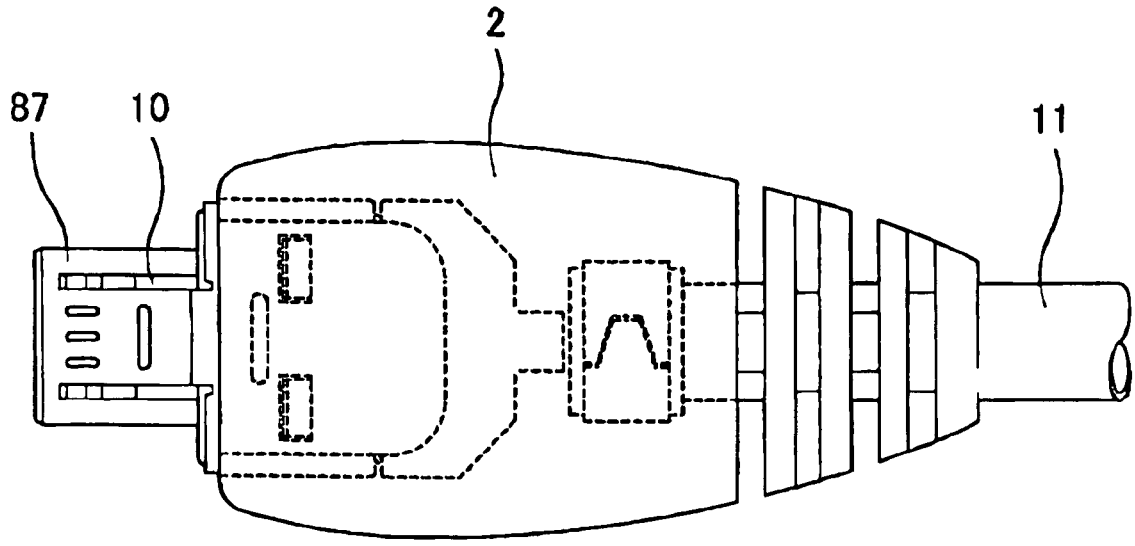
FIG. 1 is a plan view showing an electrical connector according to an embodiment of the present invention.
Figure 2:
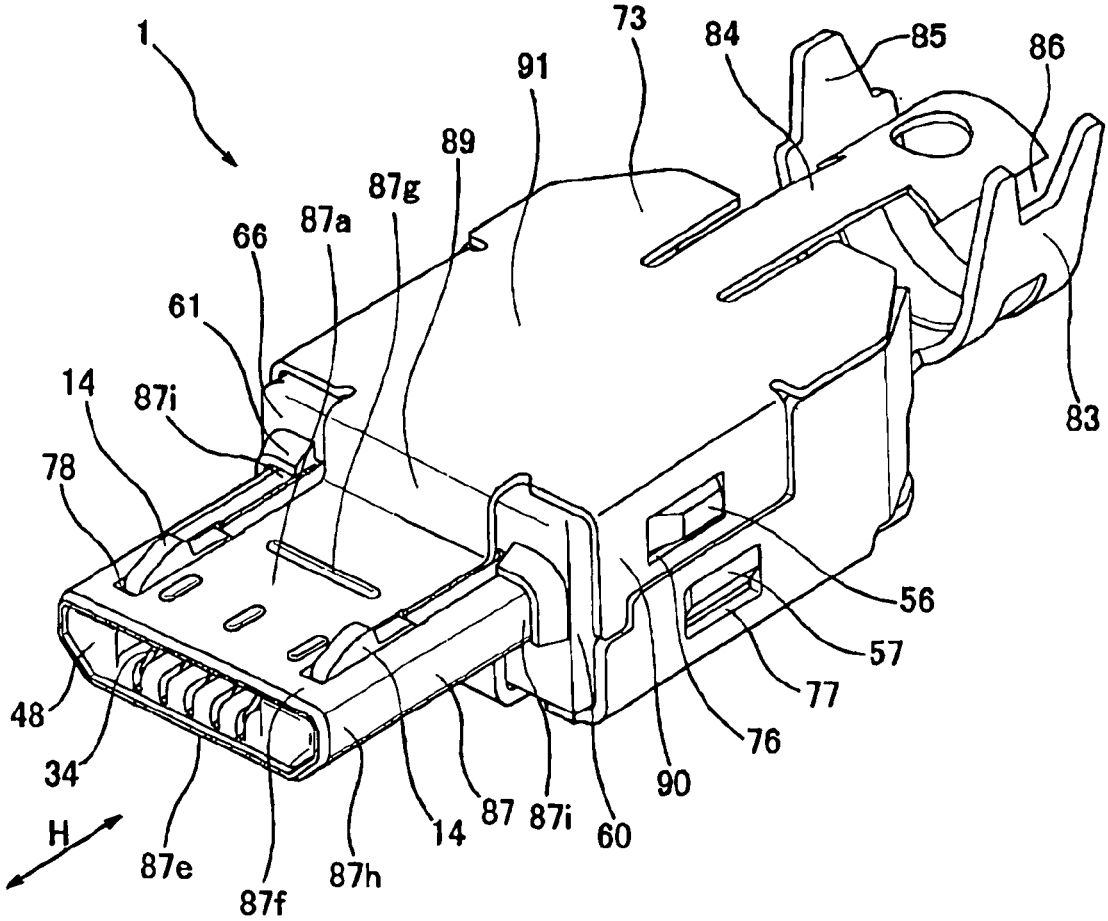
FIG. 2 is an upper perspective view showing the electrical connector before an outside cover is formed of a resin according to the embodiment of the present invention.
Figure 3:
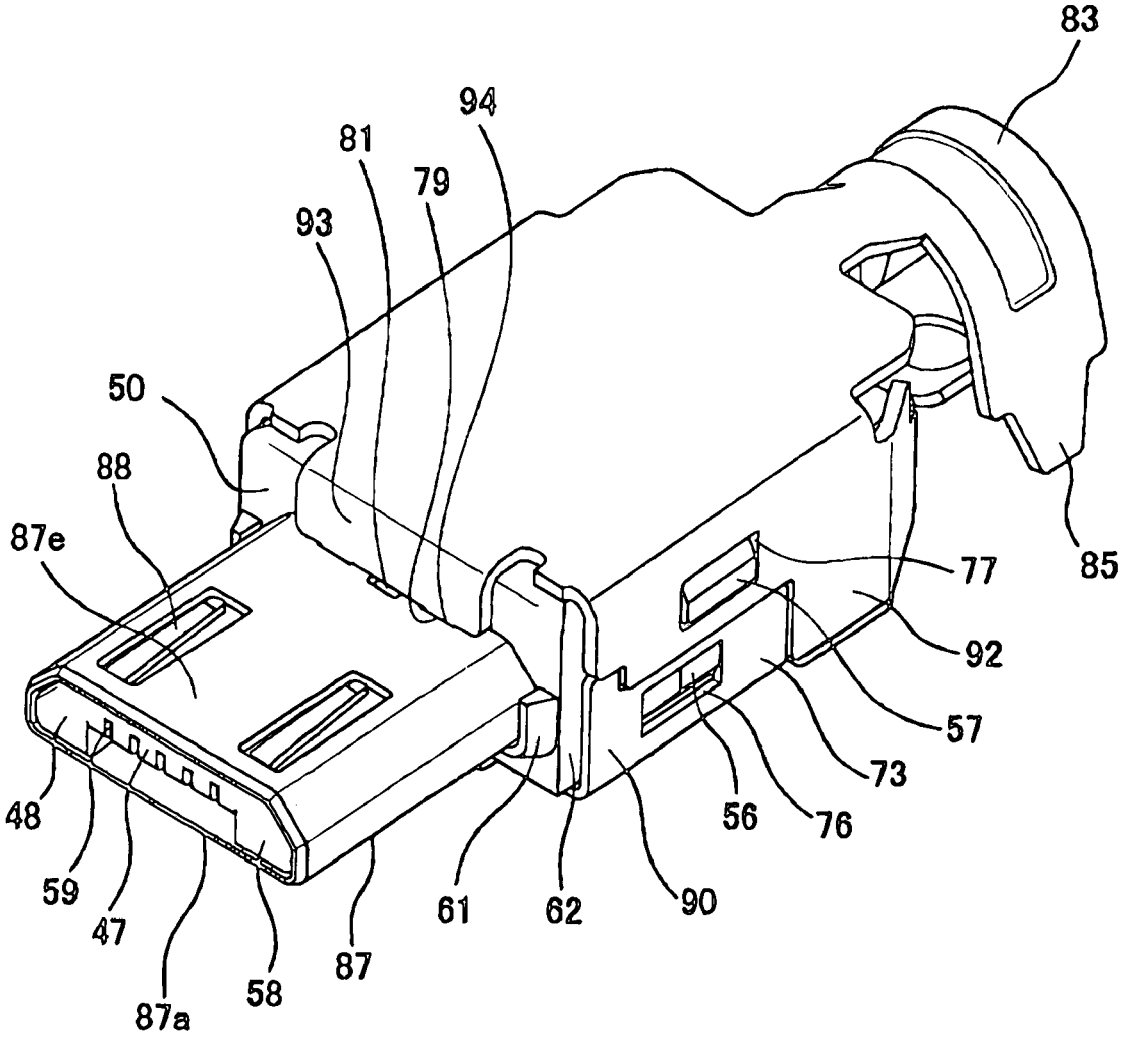
FIG. 3 is a lower perspective view of the electrical connector before the outside cover is formed of the resin.
Figure 4:
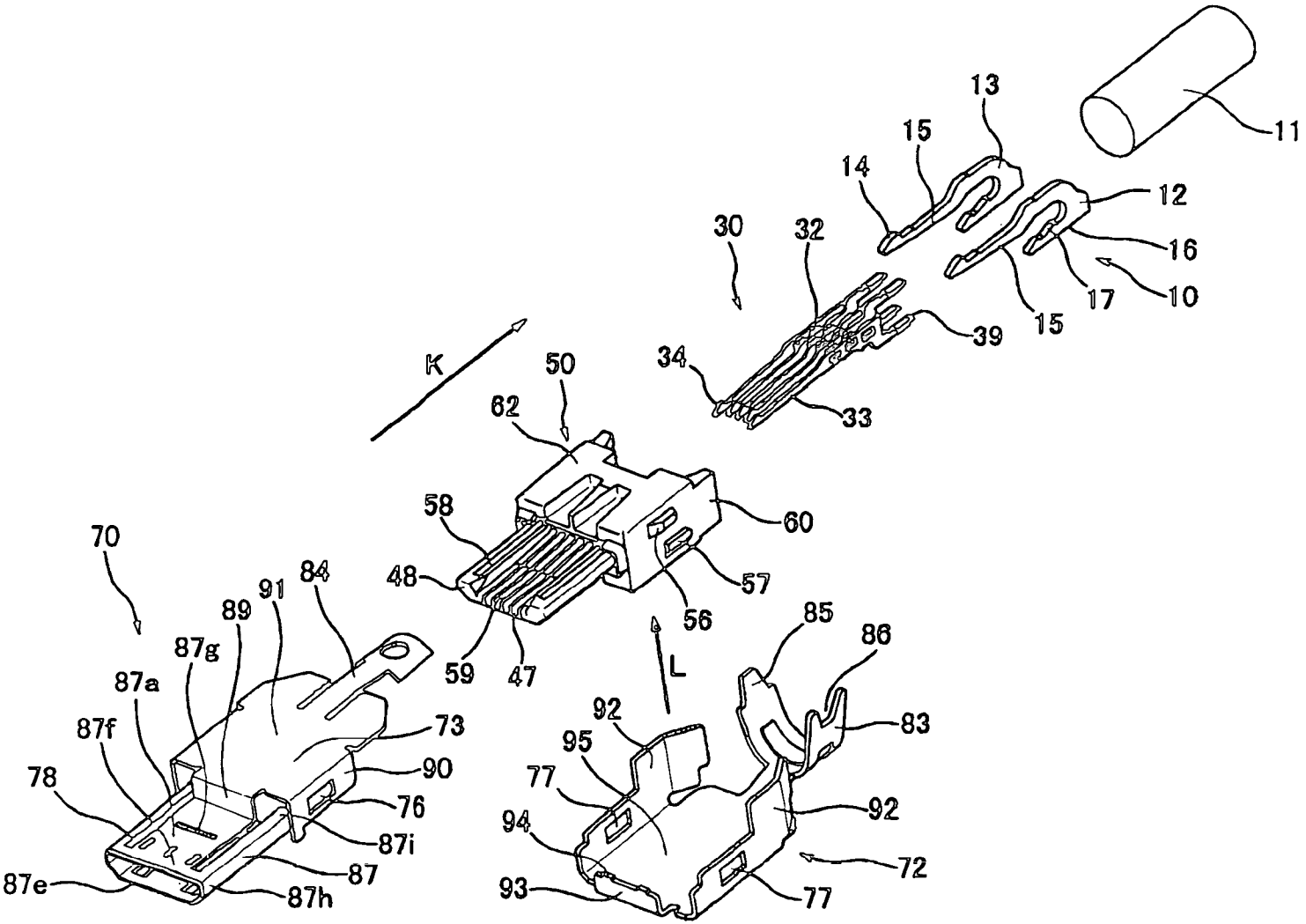
FIG. 4 is an exploded perspective view showing the electrical connector according to the embodiment of the present invention.

FIG. 1 is a plan view of an electrical connector 1 according to an embodiment of the present invention. FIG. 2 is an upper perspective view showing the electrical connector 1 before an outside cover 2 shown in FIG. 1 is formed of a resin. FIG. 3 is a lower perspective view of the electrical connector 1. FIG. 4 is an exploded perspective view of the electrical connector 1.

The electrical connector 1 mainly comprises a housing 50 integrally formed of a resin or the like; shielding members 70 and 72 formed of thin metal plates by punching out and bending; terminals 30 with a flat plate shape formed of a thin metal plate by punching out; and locking pieces 10 having a flat shape.

The shielding members comprise the first shielding member 70 and the second shielding member 72 having complimentary shapes. The shielding members are attached to an outer circumference of the housing 50 in a pair. A total of five terminals 30 are arranged in a row with a narrow pitch inside the housing 50 in parallel to a longitudinal direction thereof. Further, two locking pieces 10 are arranged in parallel to the terminals 30 in the housing 50, so that the locking pieces 10 sandwich the terminals 30 from both sides.

In the embodiment, the electrical connector 1 is used as a plug connector. In operations, the plug connector may be attached to or detached from, for example, a mating connector in a direction indicated with an arrow "H" in FIG. 2. The mating connector is a receptacle connector provided on a substrate or board. In the electrical connector 1, a housing fitting portion 58 on a distal not covered with the outside cover 2 (shown in FIG. 1) and formed of a resin and a shield fitting portion 87 in a tubular shape may fit into the receptacle connector in a detachable manner.

As shown in FIG. 4, members other than the second shielding member 72 may be, for example, fitted into each other in an arrangement direction that is a straight line indicated with an arrow "K". First, the terminals 30 and the locking pieces 10 are pressed to fit into the housing 50. Then, leads (not shown) of a cable 11 are fixed to lead fixing portions 39 of the terminals 30 with solder. Further, the first shielding member 70 is fitted into the housing 50, and the second shielding member 72 is fitted into the housing 50 from a direction indicated with an arrow "L".

In the embodiment, the first shielding member 70 and the second shielding member 72 substantially cover the housing fitting portion 58 and an outer circumferential of side faces and a rear edge side of the housing 50 when fitted into each other. At the same time, the cable 11 is arranged so that a plate portion 84 of the first shielding member 70 and a caulking portion 83 of the second shielding member 72 sandwich the cable 11.

Further, a convex portion 85 and a concave portion 86 provided at both ends of a caulking portion of the second shielding member 72 are mutually complimentary. The convex portion 85 and the concave portion 86 are fitted to caulk the cable 11 and the plate portion 84 from the outer circumference. As a result, the connector is shifted to an open state from a closed state (not shown) in a tubular shape, and the assembly is completed.

A total of five terminals 30 are shown in FIG. 3, but the number of the terminals 30 is not limited to five. For example, two of the terminals 30 may be used for data communication; two of the terminals 30 may be used as spares; and one remaining terminal 30 may be used for grounding. The terminals 30 may cancel positive and negative noises to maintain a transmission property when used in a pair.

A size and a length of a fixed portion 32 and an arm portion 33 of each terminal 30 are substantially identical in all terminals. The arm portion 33 is in a tapered shape toward a pressing direction and includes a contact portion 34 facing upwardly on a distal thereof. The contact portions 34 contact with contact portions of mating terminals of the mating connector when the electrical connector 1 and the mating connector are fitted. The contact portion 34 may send an electrical signal from the cable 11 to the mating connector.

Each of the locking pieces 10 comprises a base portion 12; a pressed fixing portion 16 extending from the base portion 12 to a mating connector direction; and an arm portion 15 extending from the base portion 12 to the mating connector direction in an approximate parallel to a pressed fixing portion 16. When the locking piece 10 is fitted to the housing 50, the pressed portion 16 is pressed to fix to a pressed portion 52 of the housing 50 using a pressed protrusion 17 of the arm portion 15.

In the embodiment, a bent portion 13 of the arm portion 15 provides a spring, and an approximate body including the locking portion 14 area provided at a distal of the arm portion 15 may be elastically displaced at a specific amount in a height direction (a displacement direction of the arm portion 15).

When the connector fits into the mating connector, the locking portion 14 engages with an engaged portion (not shown) of the mating connector and may maintain the fitting state with the mating connector. A displacement of the locking portion 14 in a height direction may be naturally obtained when the connector 1 is plugged or unplugged from the mating connector. Accordingly, the plug connector 1 and the mating connector may be easily locked or unlocked through the plug and unplug actions.

Figure 5:
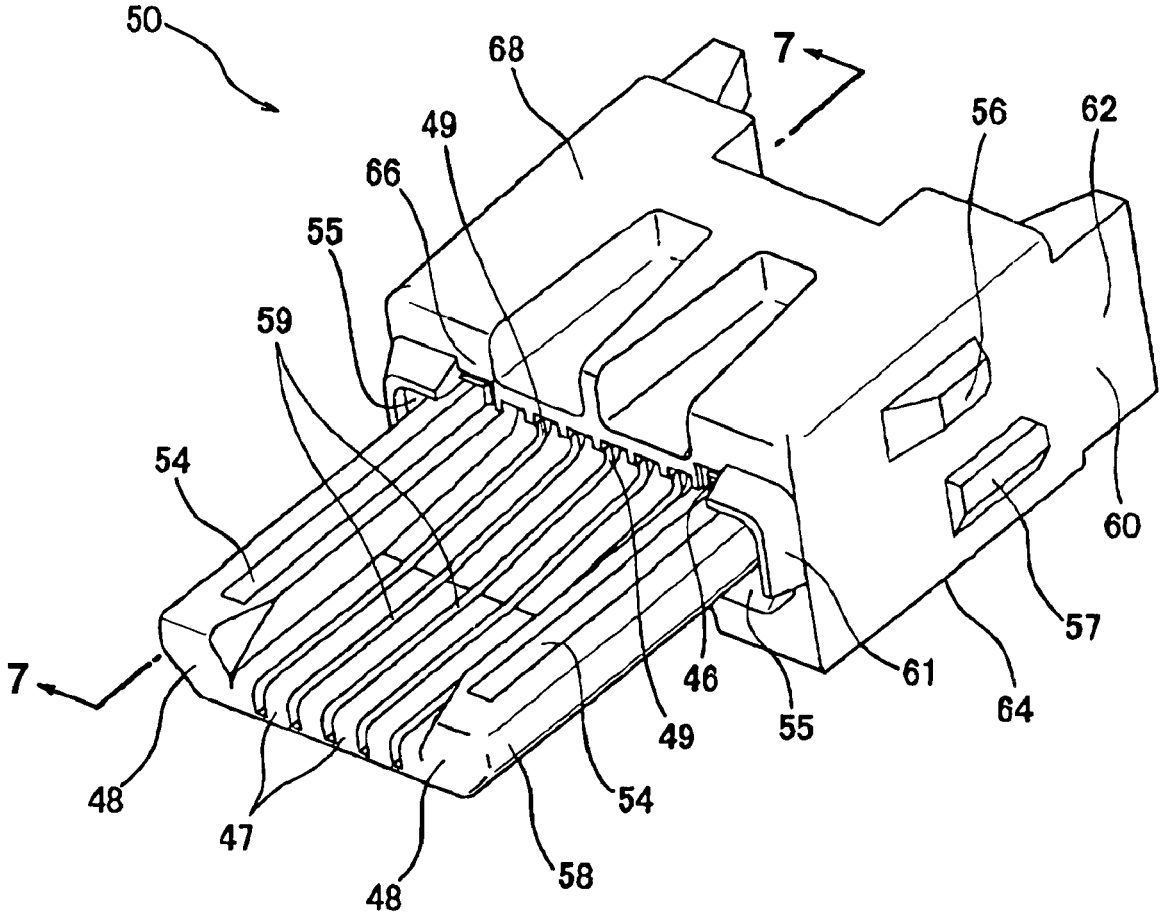
FIG. 5 is an upper perspective view showing a housing of the electrical connector according to the embodiment of the present invention.
Figure 6:
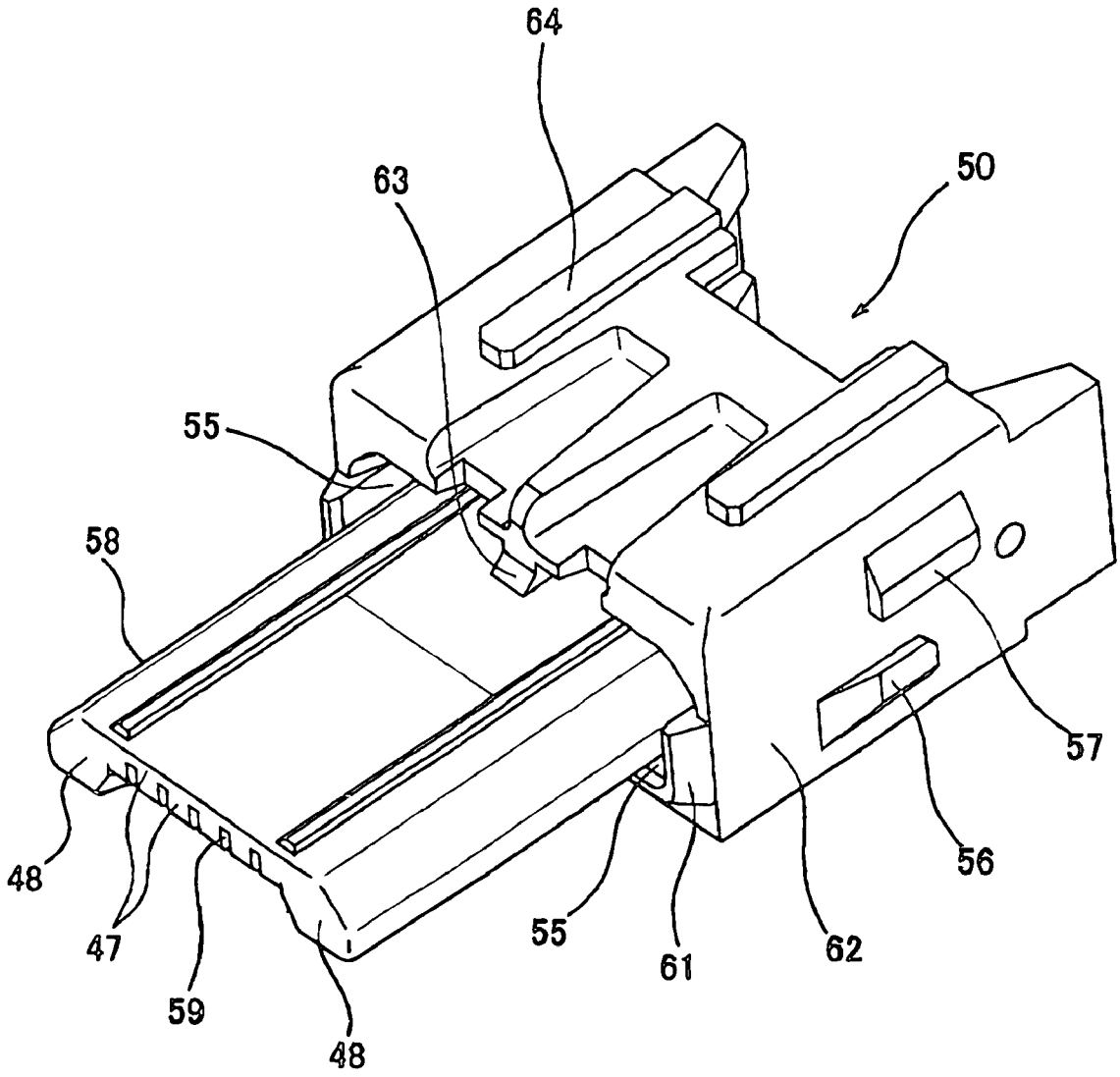
FIG. 6 is a lower perspective view of the housing of the electrical connector according to the embodiment of the present invention.
Figure 7:
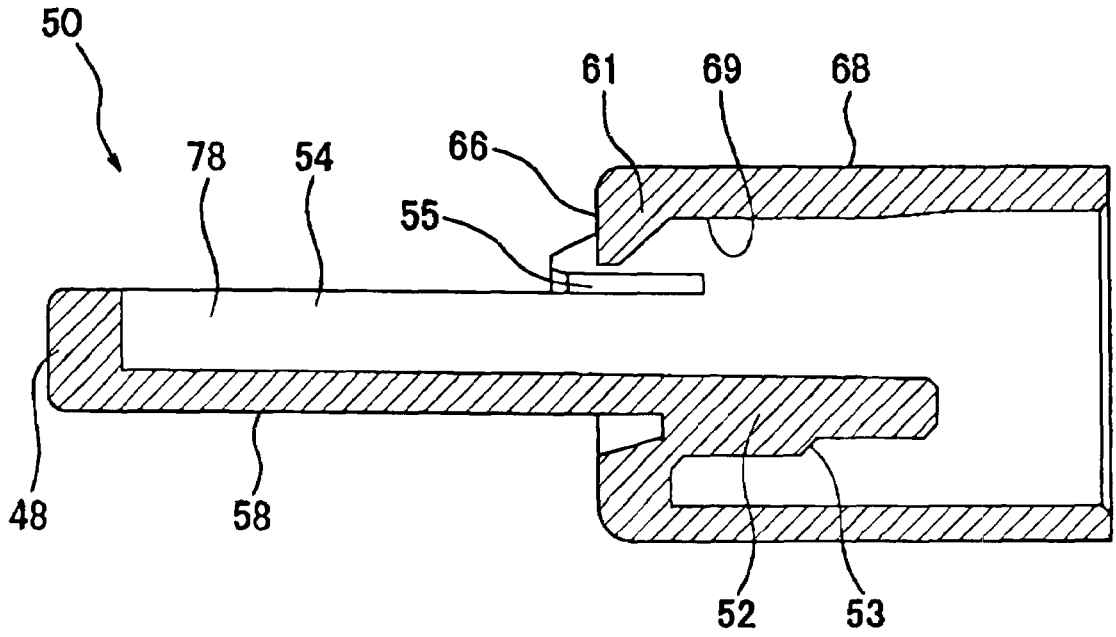
FIG. 7 is a sectional view taken along a line 7-7 in FIG. 5.

FIGS. 5 to 7 show a detailed configuration of the housing 50. FIG. 5 is an upper external perspective view of the housing 50. FIG. 6 is a lower external perspective view of the housing 50. FIG. 7 is a sectional view taken along a line 7-7 in FIG. 5.

As shown in FIGS. 5 to 7, the housing 50 includes a housing body portion 62 and the housing fitting portion 58 in a plate shape protruding from the housing body portion 62 to a distal of the housing 50 (mating connector side). The fixed portions 32 of the terminals 30 and pressed fixing portions 16 of the locking pieces 10 are fixed to the housing body portion 62. The terminals 30 and the locking pieces 10 are arranged along the protruding direction.

On a rear base portion of the housing fitting portion 58, grooves 55 are provided in a circumference except for an upper front wall surface 66 of the housing 50, near locking holes 46 for guiding the locking pieces 10, and a supporting column 63 (shown in FIG. 6) provided on the opposite side of a side of the housing fitting portion 58 having the locking pieces 10 and the terminals 30. The grooves 55 are provided inward of the housing 50 in an opposite direction of a protruding direction of the housing fitting portion 58.

In the embodiment, corresponding to the grooves 55, parts or held portions 87*i* of the rear base portions (shown in FIG. 8) of the first shielding member 70 protrude from a housing body portion 62 in the opposite direction of the mating connector side. In the configuration, the grooves 55 may sandwich the parts 87*i* of the rear base portions (shown in FIG. 8) of the first shielding member 70, so that the first shielding member 70 covers a larger area of the housing fitting portion 58. The strength of the housing fitting portion 58 is thereby improved. Further, strength of the shielding fitting portion 87 prone to a twisting force and protruding from a shielding body portion 73 is improved. Accordingly, the connector becomes more resistant to twisting force.

The terminals 30 and the locking pieces 10 are pressed into the housing 50 in parallel through vertical openings or holes (not shown) provided in a backside of the housing 50. Accordingly, a resin to form the outside cover 2 does not flow into the holes at least in the arrangement direction. An upper half of the arm portions 33 and the contact portions 34 are exposed through terminal openings 49 communicating with the vertical openings after the terminals 30, and the locking pieces 10 are pressed into the housing 50.

Further, the arm portions 33 of the terminals 30 are elastically held along terminal grooves 59 of a thin wall portion 47 of the housing fitting portion 58. Similarly, the locking pieces 10 are elastically held along the grooves 54 provided in the thick wall portion 48 of the housing fitting portion 58 through the locking holes 46 communicating with the vertical openings. The approximate upper half of the arm portion 15 and the locking portions 14 are exposed and slightly stand out from the housing 50 (the thin wall portion 47 of the housing fitting portion 58). When the connector fits into the mating connector, the locking pieces 10 engage with an engaged portion of the mating connector using elastically displaceable locking portions 14. The fitting state of the electrical connector 1 and the mating connector are thereby maintained.

Figure 8:
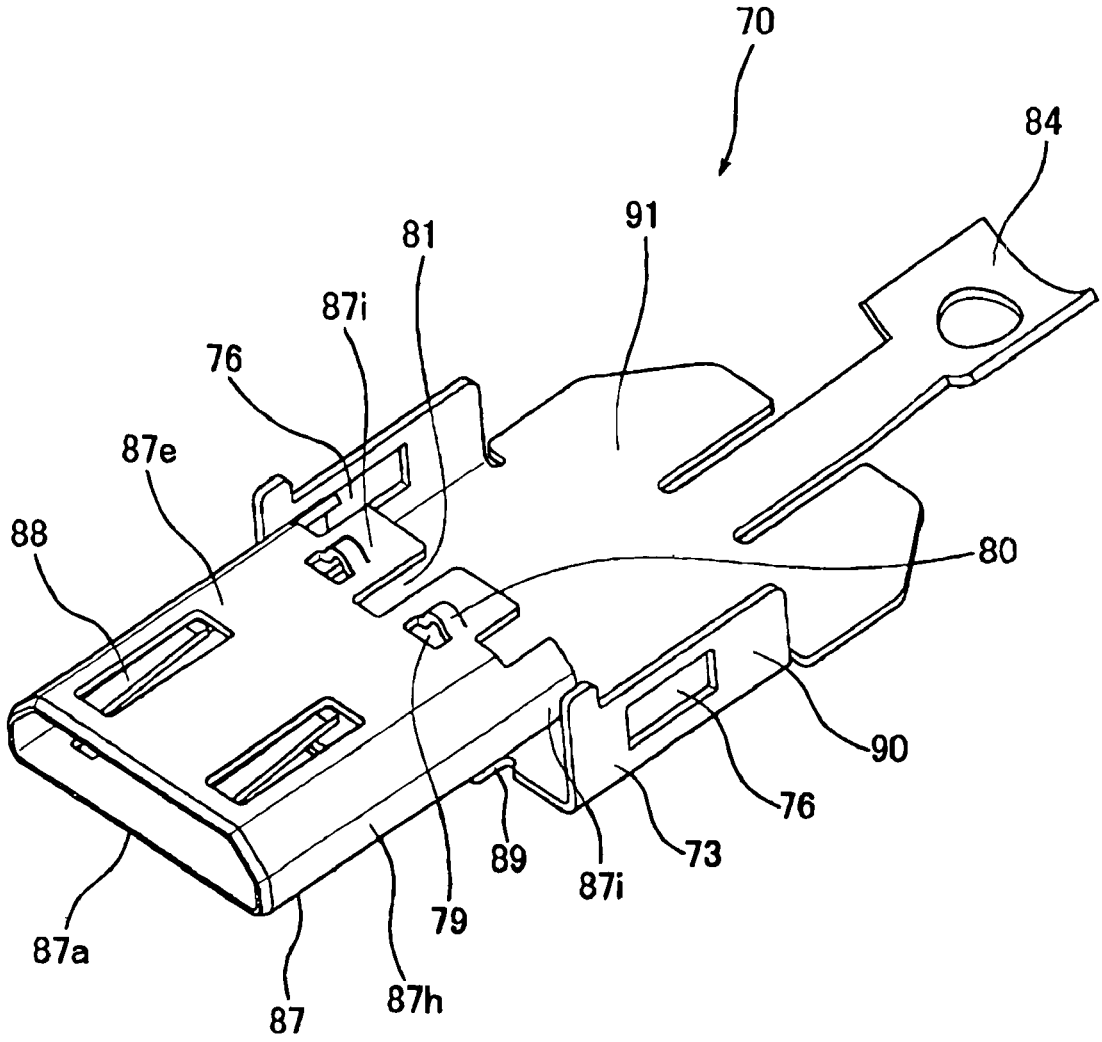
FIG. 8 is a lower perspective view showing a first shielding member of the electrical connector according to the embodiment of the present invention.
Figure 9:
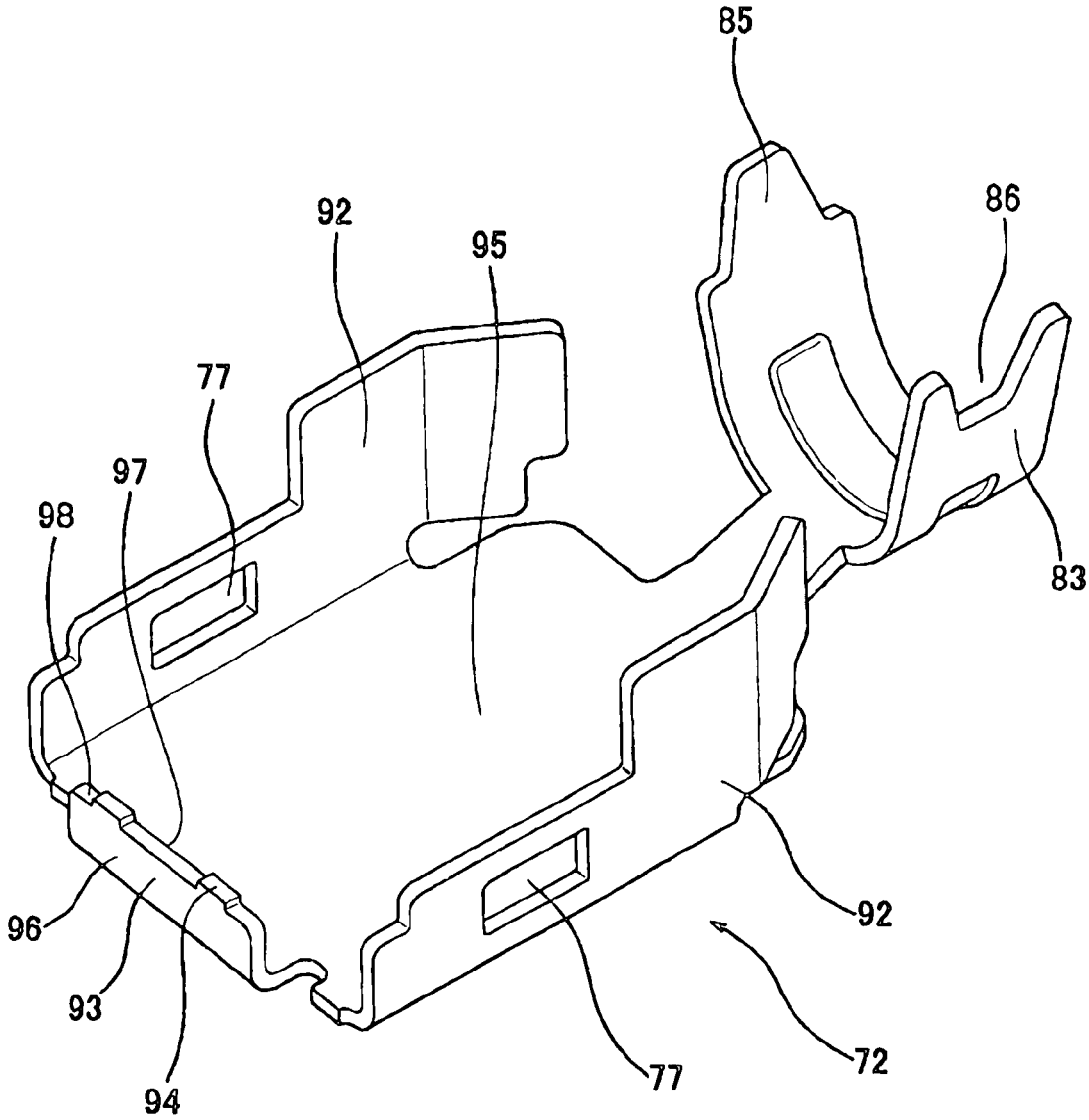
FIG. 9 is an upper perspective view showing a second shielding member of the electrical connector according to the embodiment of the present invention.
Figure 10:
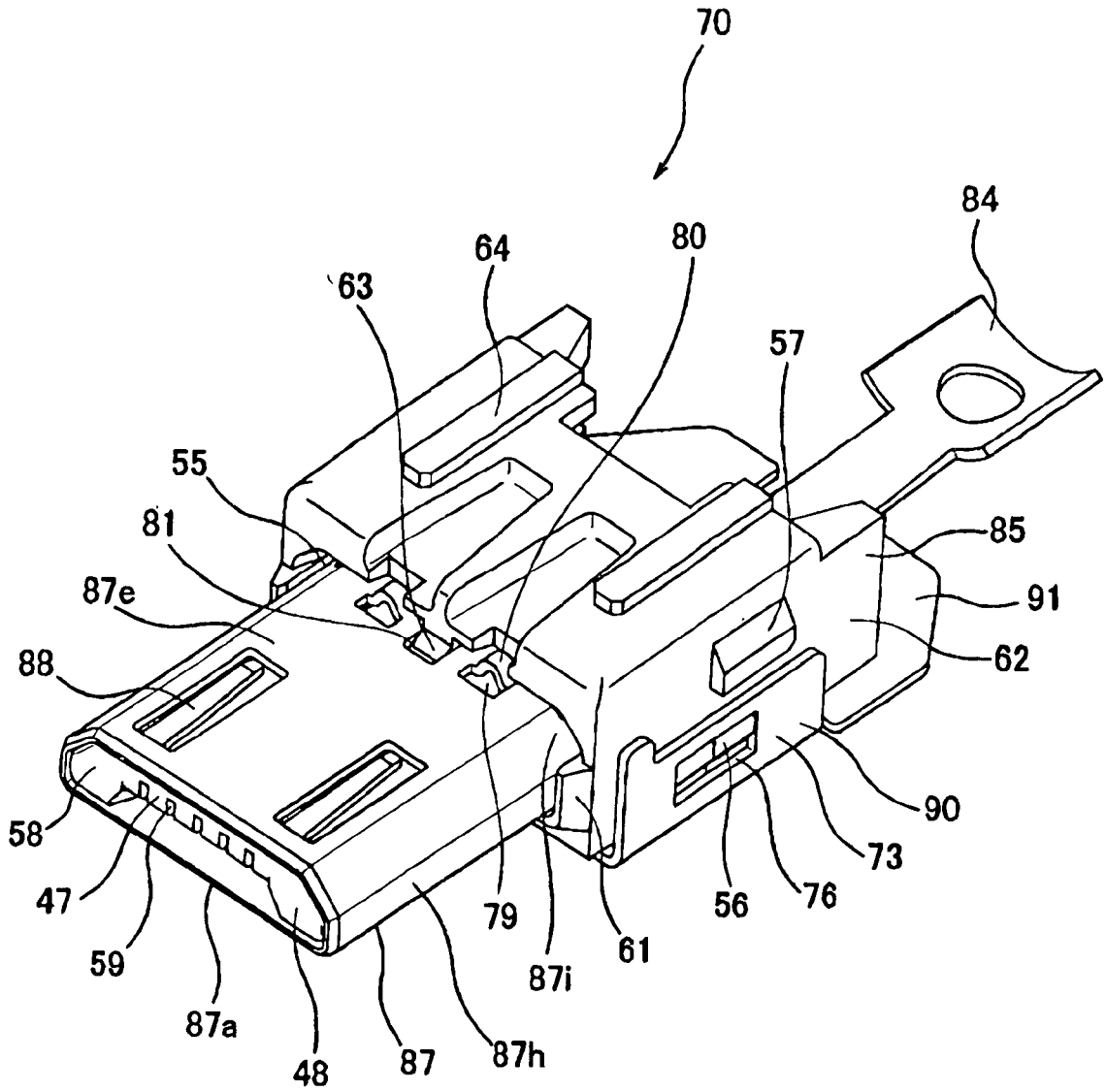
FIG. 10 is a perspective view showing the first shielding member attached to the housing.

Next, the shielding members are explained in reference to FIGS. 8 to 10. FIG. 8 is a lower perspective view of the first shielding member 70. FIG. 9 is an upper perspective view of the second shielding member 72. FIG. 10 shows the housing 50 having only the first shielding member 70.

In the embodiment, the first shielding member 70 comprises a shield fitting portion 87; the first shield body portion 73; and a bending portion (connection portion) 89. The shield fitting portion 87 in a tubular shape covers the housing fitting portion 58 along the protruding direction thereof. The first shield body portion 73 covers a part of the rest of the housing 50. The bending portion 89 connects a top wall 91 of the first shield body portion 73 and the shield fitting portion 87, and covers the upper front wall surface 66 of the housing 50 from a front part.

The first shield body portion 73 provides, for example, the top wall 91 to cover an upper face 68 (FIG. 5) of the housing 50 and sidewalls 90 to cover top halves of the side faces 60 (FIG. 5).

Slits 78 are provided in the shield fitting portion 87 to place the locking pieces 10. The slits 78 are open at the rear base portions 87*i* of the shield fitting portion 87 and closed at a connection portion 87*f* in a front part of the shield fitting portion 87. That is, the shield fitting portion 87 is provided with an upper flat portion 87*a*, a bent portion 87*h*, and the lower flat portion 87*e*. The upper flat portion 87*a* is sandwiched by a pair of the slits 78. The bent portions 87*h* are connected through the connection portion 87*f*. The lower flat portion 87*e* faces and is arranged in parallel to the upper flat portion 87*a*.

As shown in FIG. 2, the upper flat portion 87*a* provides a convex portion 87*g* extending in a direction perpendicular to an extending direction with respect to the slits 78. The convex portion 87*g* improves strength of the shield fitting portion 87, and secures the fitting state of the connector 1 and the receptacle connector.

Further, in the lower flat portion 87*e*, a cut 81 is provided at a position corresponding to the supporting column 63 to avoid a collision with the supporting column 63 of the housing 50 when the first shielding member 70 is fitted into the housing 50. A holding piece 88 is also provided to prevent the mating connector from abutting against the connector to pull the connector when the connector is fitted into the mating connector.

In the rear base portion 87*i*, a dent portion and a regulating portion is provided. The dent portion is, for example, a through hole 79 or the like made by punching out the lower flat portion 87*e*. The regulating portion is, for example, a protruding portion 80 or the like provided next to the dent portion. The protruding portion 80 is provided to regulate an extending portion 93 of the second shielding member 72.

Further, the protruding portion 80 is situated on the opposite side with respect to a protruding direction of the shield fitting portion 87 and protrudes toward the second shielding member 72. The protruding portion 80 improves an anti-twisting property of the connector (explained later). Further, the protruding portions 80 are made by punching out a lower part of the rear base portions 87*i* of the shield fitting portion 87 in a direction perpendicular to an protruding direction of the housing fitting portion 58 to form a tongue piece externally, and by bending the tongue piece in an arc shape. The protruding portion 80 may also be made by, for example, punching out the rear base portions 87*i* to form a tongue piece externally in the protruding direction of the housing fitting portion 58 and simply bending at a right angle. The configuration shown in FIG. 8 provides a stronger regulation portion because a plate thickness with respect to the plate surface direction may be effectively utilized.

As shown in FIG. 10, when the first shielding member 70 is fitted into the housing 50, the shield fitting portion 87 of the first shielding member 70 covers an approximate circumference of the housing fitting portion 58 circularly. At this time, the rear base portions 87*i* of the shield fitting portions 87 are inserted to the grooves 55 of the housing 50 and held there. The first shielding member 70 is securely fixed against the housing 50 by holding the rear base portions 87*i* with the grooves 55. Accordingly, the connector may have more resistance to twisting force.

Further, corner protruding portions 61 protruding frontward of the housing 50 cover near a root of the rear base portions 87*i* inserted to the grooves 55 from an upper portion to side faces externally. The connector becomes even more resistant to a twisting force.

In the embodiment, the second shielding member 72 mainly comprises the second shield body portion (including, for example, the side walls 92 covering side faces of the housing 50 or a bottom face 64 and a bottom wall 95) covering a part of the housing body portion 62, and a front extending portion 93 extending from the second shield body portion to the shield fitting portion 87 of the first shielding member 70 when the second shielding member 72 is fitted into the first shielding member 70.

The extending portion 93 is provided with protruding portions 94 to be inserted into the through holes 79 of the first shielding member 70 when the first shielding member 70 is fitted into the second shielding member 72. The first shielding member 70 and the second shielding member 72 are fitted more securely by inserting the protruding portions 94 into the through holes 79. Further, the protruding portions 80 of the first shielding member 70 strengthen an anti-twisting force and thereby downsize the connector. Especially, a height direction of the connector may be downsized.

Figure 11:
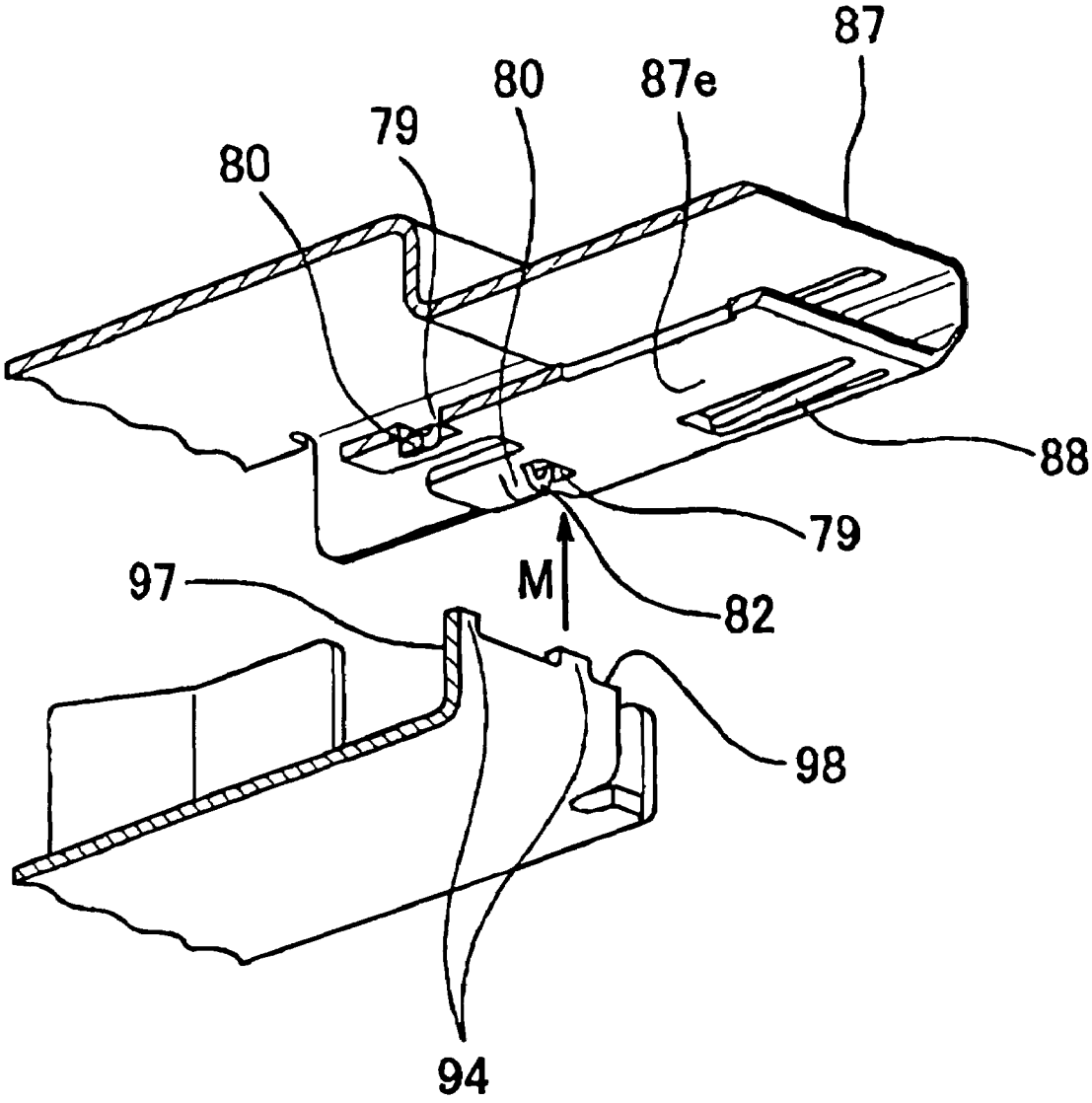
FIG. 11 is a sectional perspective view of the first shielding member and the second shielding member before fitted.
Figure 12:
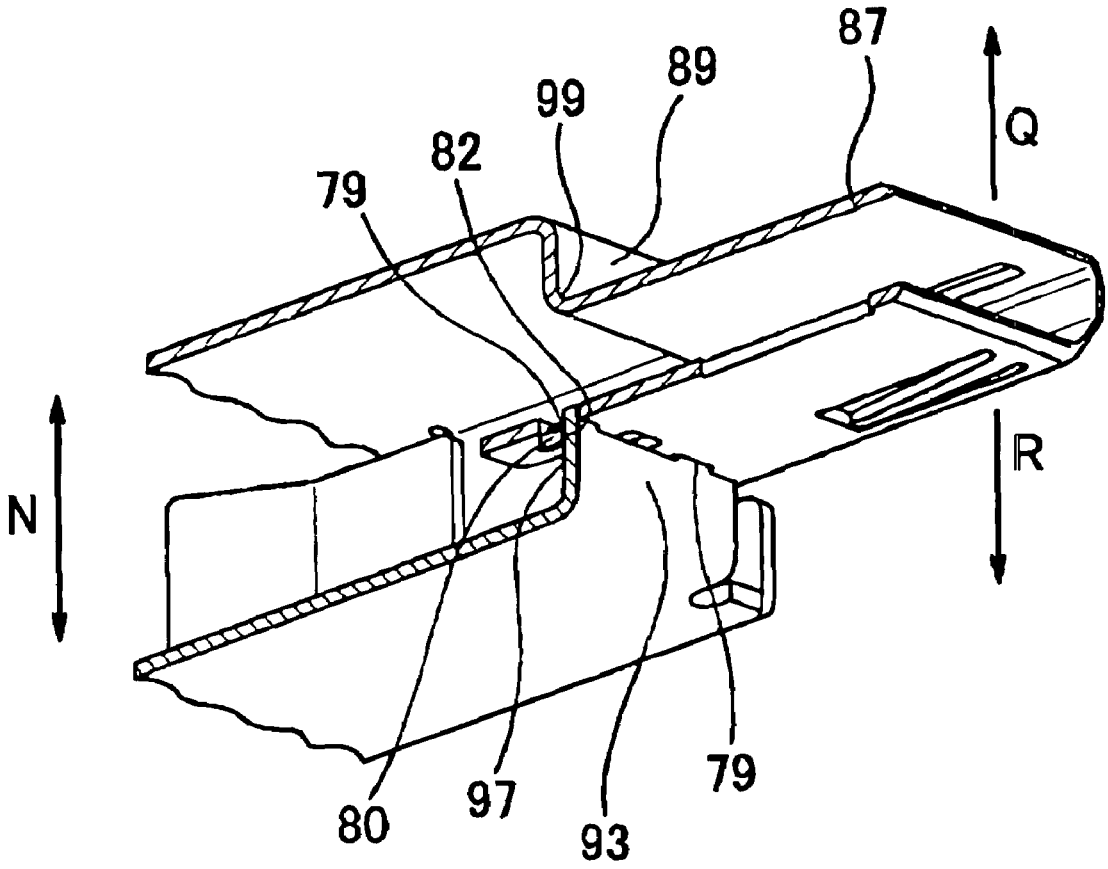
FIG. 12 is a sectional perspective view of the first shielding member and the second shielding member before a state that the first shielding member and the second shielding member are assembled.
Figure 13:
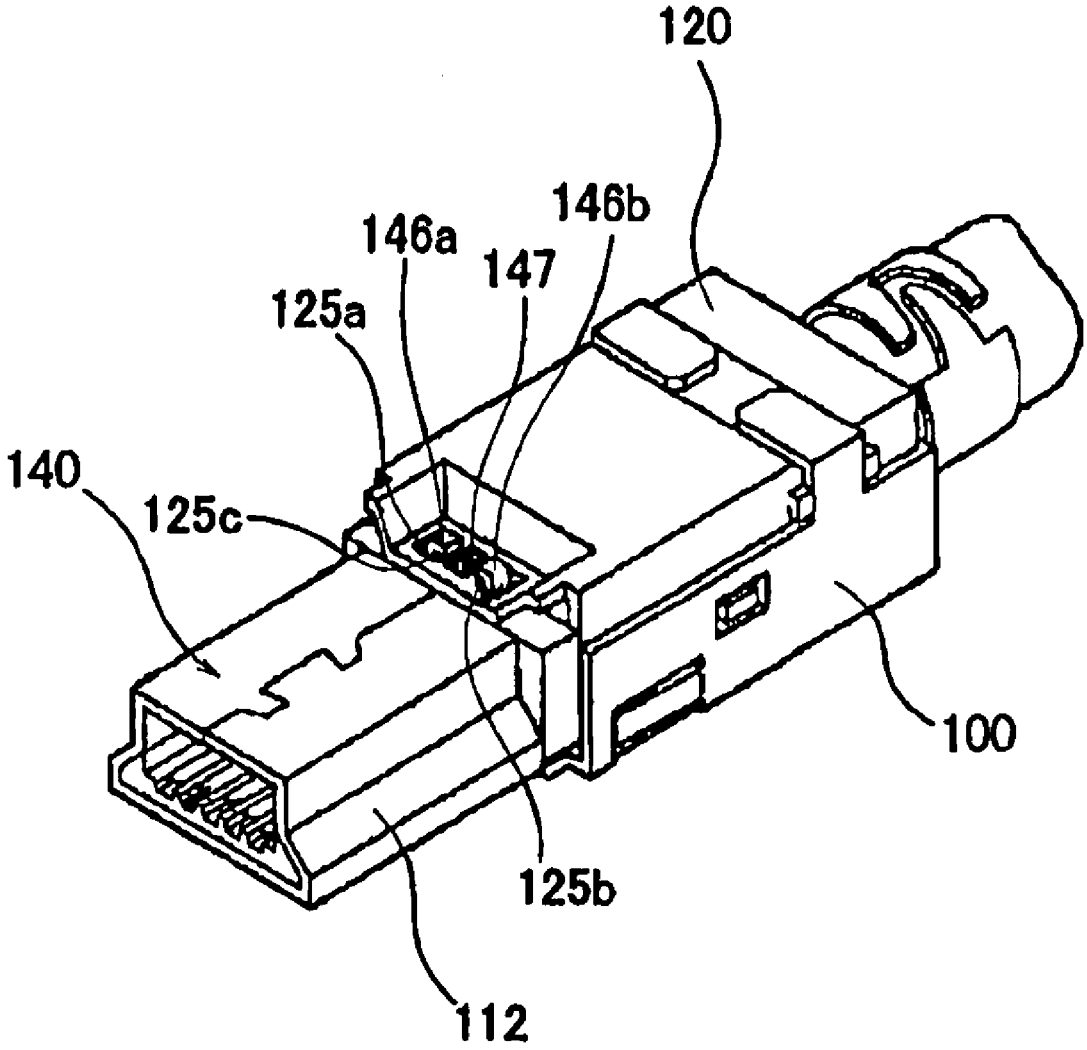
FIG. 13 PRIOR ART
FIG. 13 is a perspective view showing a conventional plug connector.

A reinforcing property against the twisting force using the protruding portions (regulating portions) 80 of the first shielding member 70 will be explained in reference to FIGS. 11 and 12. FIGS. 11 and 12 show only the first shielding member 70 and the second shielding member 72 for the sake of simplicity. FIG. 11 is a sectional perspective view at an approximate center of the protruding portion 80 of the first shielding member 70 and the protruding portion 94 of the second shielding member 72 before the first shielding member 70 and the second shielding member 72 are fitted. FIG. 12 shows, in a similar way, a configuration after the first shielding member 70 and the second shielding member 72 are fitted.

The second shielding member 72 is shifted to be in a shape shown in FIG. 12 by, for example, being transferred toward the "M" direction shown in FIG. 11 and fitted into the first shielding member 70. In FIG. 12, in a direction indicated with an arrow "R", when a twisting force is imposed on the shield fitting portion 87, back faces 97 of the protruding portions 94 collide against the front side faces 82 of the protruding portions 80 (regulating portions). Accordingly, the extending portion 93 is regulated in a large area (a large length portion) in a height direction of the connector ("N" direction indicated by an arrow).

Therefore, the connector has higher resistance to a twisting force in a height direction thereof. When a twisting force is imposed on the shield fitting portion 87 in a direction indicated by "Q" in FIG. 12, such a motion is regulated because an area of the upper side faces 98 except for the protruding portions 94 of the extending portion 93 faces the lower flat portion 87*e* (lower face) of the shield fitting portion 87. Further, a fold line 99 between the shield fitting portion 87 and the bending portion 89 also regulates such a motion.

When the first shielding member 70 is fitted into the housing 50, engaging holes 76 provided in the sidewalls 90 engage with engaging protrusions 56 provided on the side faces 60 of the housing 50. Accordingly, the first shielding member 70 may engage with the housing 50.

When the second shielding member 72 is fitted into the housing 50, engaging holes 77 provided in sidewalls 92 engage with engaging protrusions 57 provided in the side faces 60 of the housing 50. The first shielding member 70 and the second shielding member 72 are thereby fixed to the housing 50.

The electrical connector of the present invention may be widely used for compact electronics and electrical devices.

The disclosure of Japanese Patent Application No. 2006-282847, filed on Oct. 17, 2006, is incorporated in the application by reference.

While the invention has been explained with reference to the specific embodiments of the invention, the explanation is illustrative and the invention is limited only by the appended claims.

What is claimed is:

1. An electric connector to be connected to a mating connector, comprising:

a plurality of terminals each having a fixed portion;

a housing for holding the terminals, said housing including a housing body portion for holding the fixed portions and a housing fitting portion for arranging the terminals, said housing fitting portion protruding from the housing body portion in a protruding direction toward the mating connector and having a plate shape; and a shielding member attached to the housing, said shielding member including a first shielding member and a second shielding member, said first shielding member including a shield fitting portion having a tubular shape for covering the housing fitting portion; a first shield body portion for covering the housing body portion; and a connection portion for connecting the shield fitting portion to the first shield body portion, said shield fitting portion having at least one hole portion in a base portion thereof, said second shielding member including a second shield body portion for covering the housing body portion and an extending portion extending from the second shield body portion toward the shield fitting portion, said extending portion having a protruding portion inserted into the at least one hole portion, wherein said shield fitting portion further includes a regulating projection for regulating a movement of the extending portion along the protruding direction.

2. The electric connector according to claim 1, wherein said regulating projection is arranged adjacent to the hole portion in the protruding direction.

3. The electric connector according to claim 1, wherein said regulating projection protruding toward the second shielding member.

4. The electric connector according to claim 1, wherein said shield fitting portion further includes a held portion protruding in a direction opposite to the protruding direction and inserted into a groove provided in the housing body portion.

5. The electric connector according to claim 1, wherein said shield fitting portion includes at least two regulating projections arranged along a width direction thereof perpendicular to the protruding direction.

6. The electric connector according to claim 1, wherein said shield fitting portion includes at least two hole portions arranged along a width direction thereof perpendicular to the protruding direction.

7. The electric connector according to claim 1, wherein said extending portion includes at least two protruding portions inserted into the at least two hole portions.

* * * * *